US006223958B1

(12) United States Patent
Kohn

(10) Patent No.: US 6,223,958 B1
(45) Date of Patent: May 1, 2001

(54) DEVICE FOR HOLDING A POUCH AGAINST A WRIST

(76) Inventor: Peter A. Kohn, 46 Sheen Park, Richmond, Surrey TW9 1UW (GB)

( * ) Notice: Subject to any disclaimer, the term of this patent is extended or adjusted under 35 U.S.C. 154(b) by 0 days.

(21) Appl. No.: 09/439,338

(22) Filed: Nov. 12, 1999

(51) Int. Cl.[7] ..... A45C 1/06; A45F 5/00

(52) U.S. Cl. ..... 224/219; 224/240; 224/267

(58) Field of Search ..... 224/219, 222, 224/660, 676, 681, 240, 267; 150/131, 132, 140, 141; 229/87.01

(56) References Cited

U.S. PATENT DOCUMENTS

| | | | | |
|---|---|---|---|---|
| D. 46,889 | | 1/1915 | Smith . | |
| D. 255,509 | | 6/1980 | Nathan et al. . | |
| D. 302,075 | * | 7/1989 | Burger | D2/630 |
| 940,853 | * | 11/1909 | Cardwell | 150/131 |
| 2,352,473 | | 6/1944 | Cortese . | |
| 2,358,008 | * | 12/1944 | Herbener | 150/131 |
| 2,654,409 | * | 10/1953 | Cox | 150/131 |
| 4,341,331 | | 7/1982 | McDougall . | |
| 4,781,315 | | 11/1988 | Nordskog . | |
| 5,341,972 | | 8/1994 | Jacks . | |
| 5,558,440 | * | 9/1996 | Miller | 383/87.01 |
| 5,636,775 | | 6/1997 | Kartsotis et al. . | |
| 5,671,481 | * | 9/1997 | Giard | 224/222 |
| 5,755,366 | * | 5/1998 | Mazzo | 224/222 |
| 6,108,876 | * | 8/2000 | Hubbert | 224/222 |

* cited by examiner

*Primary Examiner*—Stephen P. Garbe

(57) ABSTRACT

A device for holding a pouch against a wrist for holding a pouch with the aid of a watch band. The device for holding a pouch against a wrist includes a pouch. The pouch comprises a panel. The panel is L-shaped and has a long portion and short portion. The panel has a front side and a back side. A first securing strip is fixedly coupled to the back side of the short portion of the panel. The first securing strip has a securing means attached thereon. A second securing strip is fixedly coupled to the front side of the long portion of the panel. The second securing strip is located generally at a middle section of the long portion of the panel. The second securing strip has a securing means thereon adapted to secure the first securing strip to the second securing strip. A third securing strip has a distal portion and a proximal portion. The proximal portion of the strip is fixedly coupled generally adjacent to the second securing strip. The third securing strip has a longitudinal axis orientated substantially parallel with a longitudinal axis of the long portion of the panel. The distal portion of the third securing strip has a front surface and a back surface. The front and back surfaces of the third securing strip has a hook and loop securing means located thereon.

11 Claims, 3 Drawing Sheets

DEVICE FOR HOLDING A POUCH AGAINST A WRIST

BACKGROUND OF THE INVENTION

1. Field of the Invention

The present invention relates to pouches and more particularly pertains to a new device for holding a pouch against a wrist for holding a pouch with the aid of a watch band.

2. Description of the Prior Art

The use of pouches is known in the prior art. More specifically, pouches heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,341,972; U.S. Pat. No. 4,341,331; U.S. Pat. No. 2,352,473; U.S. Pat. No. 4,781,315; U.S. Pat. No. 5,636,775; and U.S. Pat. No. Des. 46,889.

While these devices fulfill their respective, particular objectives and requirements, the aforementioned patents do not disclose a new device for holding a pouch against a wrist. The inventive device includes a pouch. The pouch comprises a panel. The panel is L-shaped and has a long portion and short portion. The panel has a front side and a back side. A first securing strip is fixedly coupled to the back side of the short portion of the panel. The first securing strip has a securing means attached thereon. A second securing strip is fixedly coupled to the front side of the long portion of the panel. The second securing strip is located generally at a middle section of the long portion of the panel. The second securing strip has a securing means thereon adapted to secure the first securing strip to the second securing strip. A third securing strip has a distal portion and a proximal portion. The proximal portion of the strip is fixedly coupled generally adjacent to the second securing strip. The third securing strip has a longitudinal axis orientated substantially parallel with a longitudinal axis of the long portion of the panel. The distal portion of the third securing strip has a front surface and a back surface. The front and back surfaces of the third securing strip has a hook and loop securing means located thereon.

In these respects, the device for holding a pouch against a wrist according to the present invention substantially departs from the conventional concepts and designs of the prior art, and in so doing provides an apparatus primarily developed for the purpose of holding a pouch with the aid of a watch band.

SUMMARY OF THE INVENTION

In view of the foregoing disadvantages inherent in the known types of pouches now present in the prior art, the present invention provides a new device for holding a pouch against a wrist construction wherein the same can be utilized for holding a pouch with the aid of a watch band.

The general purpose of the present invention, which will be described subsequently in greater detail, is to provide a new device for holding a pouch against a wrist apparatus and method which has many of the advantages of the pouches mentioned heretofore and many novel features that result in a new device for holding a pouch against a wrist which is not anticipated, rendered obvious, suggested, or even implied by any of the prior art pouches, either alone or in any combination thereof.

To attain this, the present invention generally comprises a pouch. The pouch comprises a panel. The panel is L-shaped and has a long portion and short portion. The panel has a front side and a back side. A first securing strip is fixedly coupled to the back side of the short portion of the panel. The first securing strip has a securing means attached thereon. A second securing strip is fixedly coupled to the front side of the long portion of the panel. The second securing strip is located generally at a middle section of the long portion of the panel. The second securing strip has a securing means thereon adapted to secure the first securing strip to the second securing strip. A third securing strip has a distal portion and a proximal portion. The proximal portion of the strip is fixedly coupled generally adjacent to the second securing strip. The third securing strip has a longitudinal axis orientated substantially parallel with a longitudinal axis of the long portion of the panel. The distal portion of the third securing strip has a front surface and a back surface. The front and back surfaces of the third securing strip has a hook and loop securing means located thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for holding a pouch against a wrist apparatus and method which has many of the advantages of the pouches mentioned heretofore and many novel features that result in a new device for holding a pouch against a wrist which is not anticipated, rendered obvious, suggested, or even implied by any of the prior art pouches, either alone or in any combination thereof.

It is another object of the present invention to provide a new device for holding a pouch against a wrist which may be easily and efficiently manufactured and marketed.

It is a further object of the present invention to provide a new device for holding a pouch against a wrist which is of a durable and reliable construction.

An even further object of the present invention is to provide a new device for holding a pouch against a wrist which is susceptible of a low cost of manufacture with regard to both materials and labor, and which accordingly is then susceptible of low prices of sale to the consuming public, thereby making such device for holding a pouch against a wrist economically available to the buying public.

Still yet another object of the present invention is to provide a new device for holding a pouch against a wrist which provides in the apparatuses and methods of the prior art some of the advantages thereof, while simultaneously overcoming some of the disadvantages normally associated therewith.

Still another object of the present invention is to provide a new device for holding a pouch against a wrist for holding a pouch with the aid of a watch band.

Yet another object of the present invention is to provide a new device for holding a pouch against a wrist which includes a pouch. The pouch comprises a panel. The panel is L-shaped and has a long portion and short portion. The panel has a front side and a back side. A first securing strip is fixedly coupled to the back side of the short portion of the panel. The first securing strip has a securing means attached thereon. A second securing strip is fixedly coupled to the front side of the long portion of the panel. The second securing strip is located generally at a middle section of the long portion of the panel. The second securing strip has a securing means thereon adapted to secure the first securing strip to the second securing strip. A third securing strip has a distal portion and a proximal portion. The proximal portion of the strip is fixedly coupled generally adjacent to the second securing strip. The third securing strip has a longitudinal axis orientated substantially parallel with a longitudinal axis of the long portion of the panel. The distal portion of the third securing strip has a front surface and a back surface. The front and back surfaces of the third securing strip has a hook and loop securing means located thereon.

Still yet another object of the present invention is to provide a new device for holding a pouch against a wrist that conveniently carries money and keys when the user does not have pockets such as when exercising.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
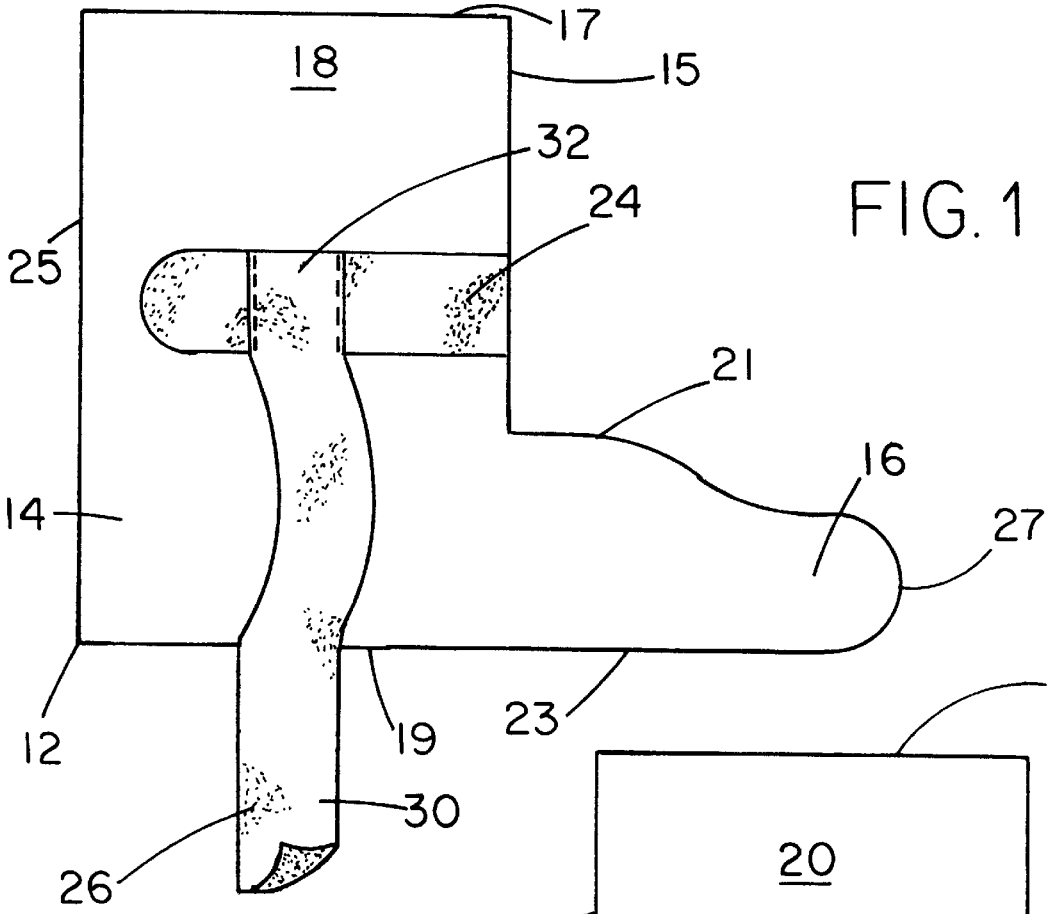
FIG. 1 is a schematic front view of a new device for holding a pouch against a wrist according to the present invention.
Figure 2:
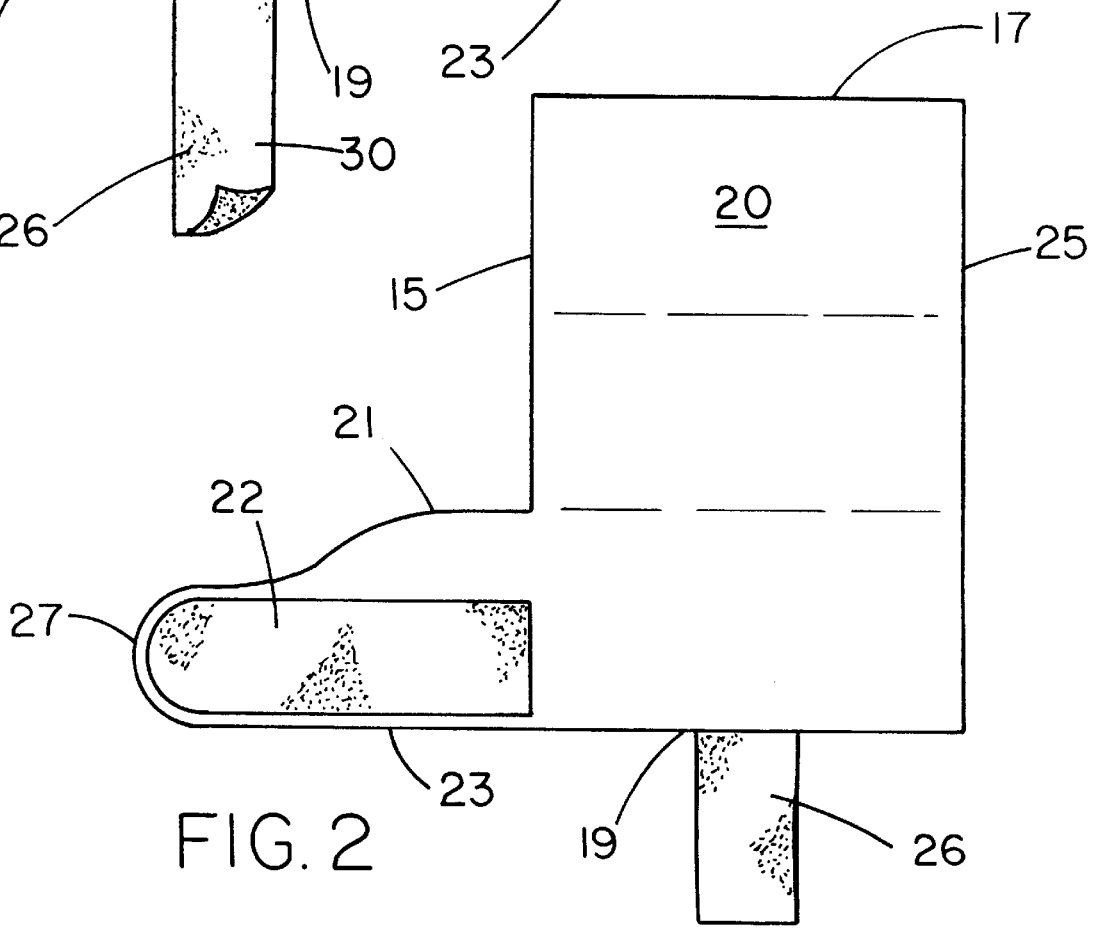
FIG. 2 is a schematic back view of the present invention.
Figure 3:
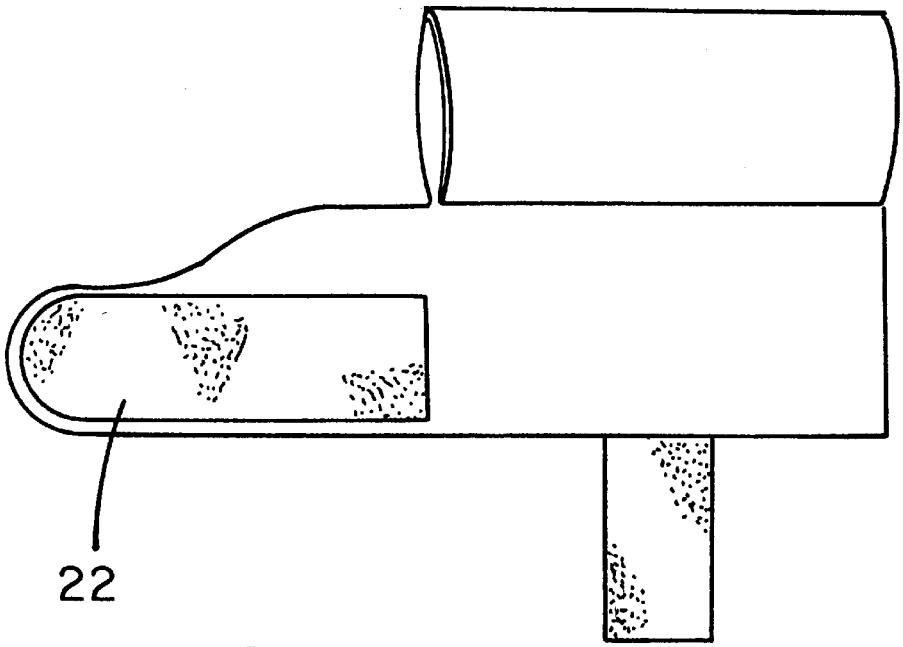
FIG. 3 is a schematic perspective view of the present invention.

With reference now to the drawings, and in particular to FIGS. 1 through 8 thereof, a new device for holding a pouch against a wrist embodying the principles and concepts of the present invention and generally designated by the reference numeral 10 will be described.

As best illustrated in FIGS. 1 through 8, the device 10 for holding a pouch against a wrist generally comprises a watch band for looping about a wearer's wrist. The pouch is comprised of a panel 12. The panel is L-shaped and has a long portion 14 and short portion 16. The short portion extends orthogonally from an edge 15 of the long portion. The panel has a front side 18 and a back side 20. Preferably, the long portion 14 has a length defined between an upper edge 17 and a lower edge 19 of the long portion. The length may be generally three times a width defined between an upper periphery 21 and a lower periphery 23 of the short portion 16. The long portion has a width defined between the edge 15 and a distal edge 25 of the long portion. The width may be approximately equal to a length of the short portion defined between the edge 15 and a distal periphery 27.

A first securing strip 22 holds the panel in a closed position. The first securing strip is elongate having the entirety of its length fixedly coupled to the back side 20 of the short portion 16 of the panel. The first securing strip 22 has a longitudinal axis oriented generally perpendicular to the longitudinal axis of the long portion 14 of the panel. The first securing strip 22 has a length approximately equal to the length of the short portion 16 of the panel. The first securing strip has a surface with a first portion of a hook and loop securing means attached thereon.

A second securing strip 24 also holds the panel in a closed position. The second securing strip is elongate having the entirety of its length fixedly coupled to the front side 18 of the long portion of the panel. The second securing member has a longitudinal axis orientated generally perpendicular to the longitudinal axis of the long portion 14. The second securing strip is located generally at a middle section of the long portion 14 of the panel 12. The second securing strip 24 has a length less than the width of the long portion 14. The second securing strip 24 has a surface with a second portion of the hook and loop securing means attached thereon whereby the second portion of the hook and loop securing means is complimentary to the first portion of the hook and loop securing means of the first securing strip.

A third securing strip 26 preferably secures the pouch to a band 28 of a wrist watch. The third securing strip 26 is elongate and has a distal portion 30 and a proximal portion 32. The proximal portion 32 of the strip is fixedly coupled to the second securing strip 24 such that the distal portion 30 of the third securing strip 26 extends toward and beyond the longitudinal axis of the short portion 16 of the panel. The third securing strip has a longitudinal axis orientated substantially parallel with the longitudinal axis of the long portion 14 of the panel. The third securing strip 26 has a length generally equal to the length of the long portion 14 of the panel. The distal portion 30 of the third elongate strip has a front surface and a back surface. The front surface of the third securing strip has a primary portion of the hook and loop securing means. The back surface of the third securing strip has a secondary portion of the hook and loop securing means. The secondary portion of the hook and loop securing means is complimentary to the primary portion of the hook and loop securing means. In FIG. 1, the distal portion 30 of the third securing strip 26 is shown curved to illustrate that the distal portion 30 of the third securing strip 26 is not coupled to the long portion 14 of the panel 12.

Figure 4:
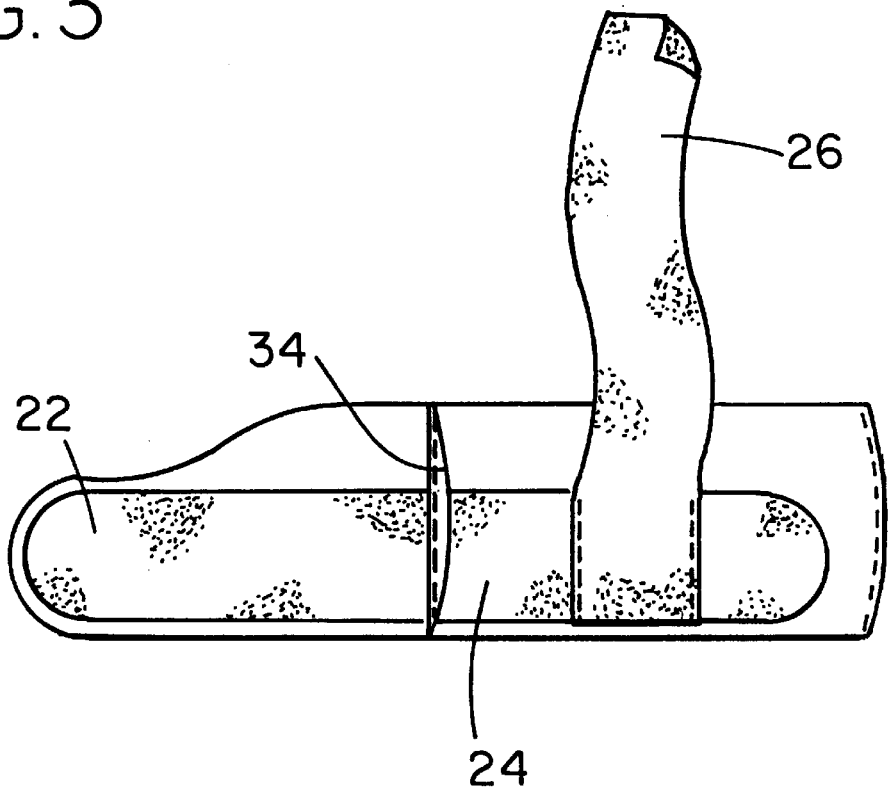
FIG. 4 is a schematic perspective view of the present invention.
Figure 5:
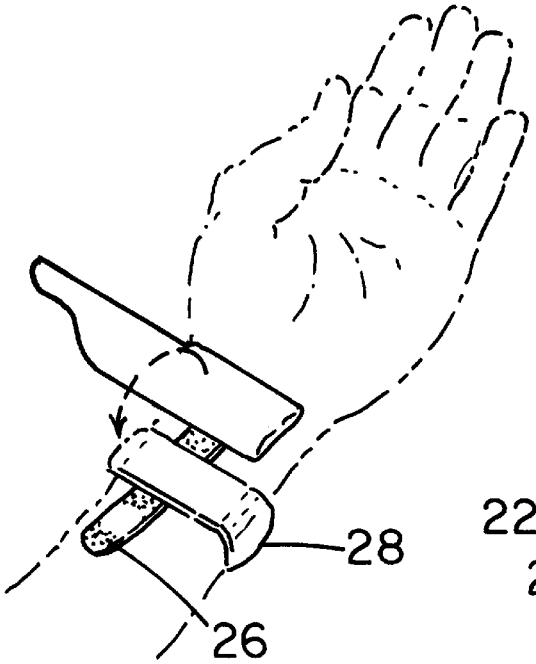
FIG. 5 is a schematic perspective view of the present invention as it is used with a wrist band.
Figure 6:
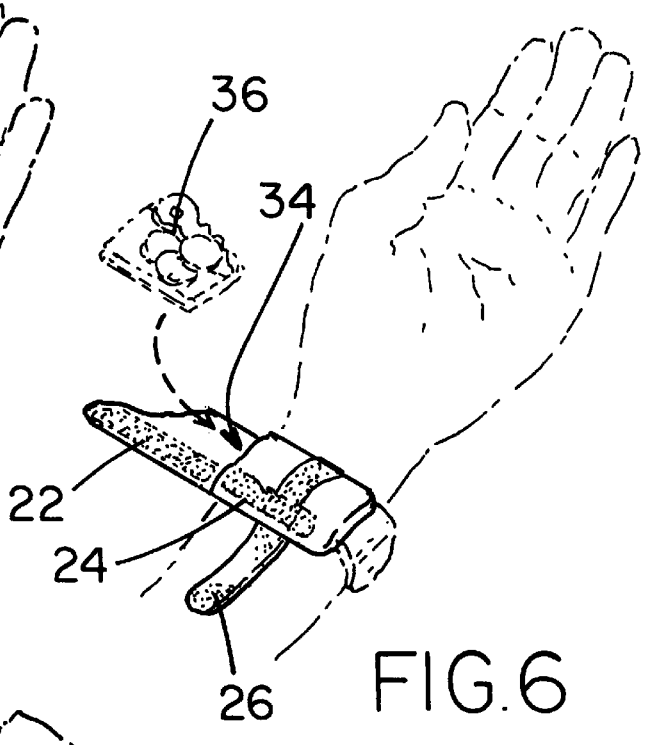
FIG. 6 is a schematic perspective view of the present invention.
Figure 7:
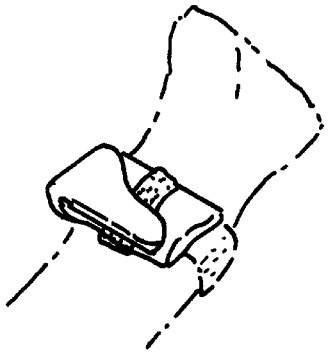
FIG. 7 is a schematic perspective view of the present invention.
Figure 8:
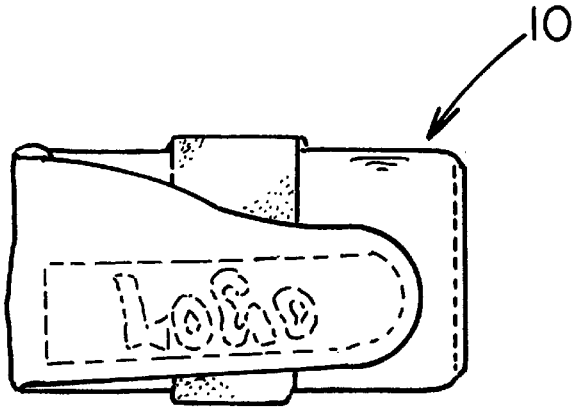
FIG. 8 is a schematic perspective view of the present invention.

In use, the long portion 14 of the panel is folded on its longitudinal axis such that two equal folds are completed. This brings the first 22 and second 24 securing strips in alignment with each other as is best depicted in FIG. 4. This creates a pouch 34 in between the folds for insertion of money, keys 36 or other items a person would generally carry in their pockets. The third securing strip 26 is wrapped around the folded portion of the panel and can either simply secure the panel in a folded position, or, as depicted in FIG. 5, it can be used to secure the panel to a wrist band of a watch 28. The short portion 16 is folded over onto the long portion 14 to bring the first securing strip 22 into contact with the second securing strip 24. This secures the pouch in a folded or closed position and additionally holds the third securing band against the second securing band.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for holding currency against a wrist, comprising:

a pouch, said pouch comprising:

a panel, said panel being L-shaped, wherein said panel has a long portion and short portion, said panel having a front side and a back side;

a first securing strip, said first securing strip being fixedly coupled to said back side of said short portion of said panel, said first securing strip having a securing means attached thereon;

a second securing strip, said second securing strip being fixedly coupled to said front side of said long portion of said panel, said second securing strip being located generally at a middle section of said long portion of said panel, said second securing strip having a securing means thereon adapted to secure said first securing strip to said second securing strip; and a third securing strip, said third securing strip having a distal portion and a proximal portion, said proximal portion of said strip being fixedly coupled generally adjacent to said second securing strip, said third securing strip having a longitudinal axis orientated substantially parallel with a longitudinal axis of said long portion of said panel, said distal portion of said third securing strip having a front surface and a back surface, said front and back surfaces of said third securing strip having a securing means located thereon.

2. The device for holding currency against a wrist as in claim 1, further including:

a watch band for looping about a wearer's wrist; and wherein said third securing strip secures said panel to said watch band.

3. The device for holding currency against a wrist as in claim 1, wherein said panel comprises:

said long portion of said panel having a length generally three times a width of said short portion, said long portion having width approximately equal to a length of said short portion.

4. The device for holding currency against a wrist as in claim 1, wherein said first and second securing strips comprise:

said first securing strip having an entirety of its length being fixedly coupled to said back side of said short portion of said panel, said first securing strip having a longitudinal axis oriented generally perpendicular to a longitudinal axis of said long portion of said panel, said first securing strip having a length approximately equal to a length of said short portion of said panel, said securing means on said first securing strip being a first portion of a hook and loop securing means; and said second securing strip having an entirety of its length being fixedly coupled to said front side of said long portion of said panel, said second securing member having a longitudinal axis orientated generally perpendicular to a longitudinal axis of said long portion, said second securing strip being located generally at a middle section of said long portion of said panel, said second securing strip having a length less than a width of said long portion, said securing means on said second securing strip being a second portion of said hook and loop securing means such that said second portion of said hook and loop securing means is complimentary to said first portion of said hook and loop securing means of said first securing strip.

5. The device for holding currency against a wrist as in claim 4, wherein said third securing strip comprises:

said third elongate strip having a length generally equal to a length of said long portion of said panel, said securing means on said front surface of said third securing strip being a primary portion of a hook and loop securing means, said securing means on said back surface of said third securing strip being a secondary portion of said hook and loop securing means such that said secondary portion of said hook and loop securing means is complimentary to said primary portion of said hook and loop securing means.

6. A device for holding currency against a wrist with the aid of a watch band, comprising:

a watch band for looping about a wearer's wrist; and a pouch, said pouch comprising:

a panel, said panel being L-shaped, wherein said panel has a long portion and short portion, said panel having a front side and a back side, said long portion having a length generally three times a width of said short portion, said long portion having width approximately equal to a length of said short portion;

a first securing strip for holding the panel in a closed position, said first securing strip being elongate, said first securing strip having an entirety of its length being fixedly coupled to said back side of said short portion of said panel, said first securing strip having a longitudinal axis oriented generally perpendicular to a longitudinal axis of said long portion of said panel, said first securing strip having a length approximately equal to said length of said short portion of said panel, said first securing strip having a surface with a first portion of a hook and loop securing means attached thereon;

a second securing strip for holding the panel in a closed position, said second securing strip being elongate, said second securing strip having an entirety of its length being fixedly coupled to said front side of said long portion of said panel, said second securing member having a longitudinal axis orientated generally perpendicular to said longitudinal axis of said long portion, said second securing strip being located generally at a middle section of said long portion of said panel, said second securing strip having a length less than said width of said long portion, said second securing strip having a surface with a second portion of said hook and loop securing means attached thereon such that said second portion of said hook and loop securing means is complimentary to said first portion of said hook and loop securing means of said first securing strip; and a third securing strip for securing said pouch to a band of a wrist watch, said third securing strip being elongate, said third securing strip having a distal portion and a proximal portion, said proximal portion of said strip being fixedly coupled to said second securing strip such that said distal portion of said third securing strip extends toward and beyond said longitudinal axis of said short portion of said panel, said third securing strip having a longitudinal axis orientated substantially parallel with said longitudinal axis of said long portion of said panel, said third securing strip having a length generally equal to said length of said long portion of said panel, said distal portion of said third elongate strip having a front surface and a back surface, said front surface of said third securing strip having a primary portion of said hook and loop securing means, back surface of said third securing strip having a secondary portion of said hook and loop securing means such that said secondary portion of said hook and loop securing means is complimentary to said primary portion of said hook and loop securing means.

7. A device for holding currency against a wrist, comprising:

a pouch comprising:

a panel being generally L-shaped such that said panel has a long portion and short portion, said panel having a front side and a back side;

a first securing strip being coupled to said back side of said short portion of said panel, said first securing strip having a securing means thereon;

a second securing strip being coupled to said front side of said long portion of said panel, said second securing strip being located generally at a middle section of said long portion of said panel, said second securing strip having a securing means thereon adapted to secure said first securing strip to said second securing strip; and a third securing strip having a distal portion and a proximal portion, said proximal portion of said strip being coupled generally adjacent to said second securing strip, said third securing strip having a longitudinal axis orientated substantially parallel with a longitudinal axis of said long portion of said panel, said distal portion of said third securing strip having a front surface and a back surface, said front and back surfaces of said third securing strip having a securing means thereon.

8. The device for holding currency against a wrist as in claim 7, further including:

a watch band for looping about a wearer's wrist; and wherein said third securing strip secures said panel to said watch band.

9. The device for holding currency against a wrist as in claim 7, wherein said long portion of said panel has a length generally three times a width of said short portion, said long portion having width approximately equal to a length of said short portion.

10. The device for holding currency against a wrist as in claim 7, wherein said first securing strip has an entirety of its length being fixedly coupled to said back side of said short portion of said panel, said first securing strip having a longitudinal axis oriented generally perpendicular to a longitudinal axis of said long portion of said panel, said first securing strip having a length approximately equal to a length of said short portion of said panel, said securing means on said first securing strip being a first portion of a hook and loop securing means; and said second securing strip having an entirety of its length being fixedly coupled to said front side of said long portion of said panel, said second securing member having a longitudinal axis orientated generally perpendicular to a longitudinal axis of said long portion, said second securing strip being located generally at a middle section of said long portion of said panel, said second securing strip having a length less than a width of said long portion, said securing means on said second securing strip being a second portion of said hook and loop securing means such that said second portion of said hook and loop securing means is complimentary to said first portion of said hook and loop securing means of said first securing strip.

11. The device for holding currency against a wrist as in claim 10, wherein said third elongate strip has a length generally equal to a length of said long portion of said panel, said securing means on said front surface of said third securing strip being a primary portion of a hook and loop securing means, said securing means on said back surface of said third securing strip being a secondary portion of said hook and loop securing means such that said secondary portion of said hook and loop securing means is complimentary to said primary portion of said hook and loop securing means.

* * * * *